United States Patent [19]

Waizer et al.

[11] 4,259,089

[45] Mar. 31, 1981

[54] GRINDING WHEEL CONTAINING GRAIN-COATED REINFORCEMENT FIBERS AND METHOD OF MAKING IT

[75] Inventors: Walter Waizer, Innsbruck; Harald Helletsberger, Wattens, both of Austria

[73] Assignee: Tyrolit Schleifmittelwerke Swarovski K.G., Austria

[21] Appl. No.: 92,755

[22] Filed: Nov. 9, 1979

Related U.S. Application Data

[63] Continuation of Ser. No. 932,623, Aug. 10, 1978, abandoned.

[51] Int. Cl.[3] ..... C09K 3/14

[52] U.S. Cl. ..... 51/295; 51/297; 51/298

[58] Field of Search ..... 51/295, 298, 309, 308, 51/297

[56] References Cited

U.S. PATENT DOCUMENTS

| | | | |
|---|---|---|---|
| 3,276,852 | 10/1966 | Lemelson | 51/298 |
| 3,495,960 | 2/1970 | Schladitz | 51/298 |
| 3,524,286 | 8/1970 | Wohrer | 51/298 |
| 3,529,945 | 9/1970 | Charvat | 51/298 |
| 3,619,152 | 11/1971 | Yalof et al. | 51/298 |
| 3,850,590 | 11/1974 | Chalkley et al. | 51/298 |
| 3,918,218 | 11/1975 | Zoiss | 51/298 |
| 4,021,209 | 5/1977 | Binkley | 51/298 |

*Primary Examiner*—Donald J. Arnold
*Attorney, Agent, or Firm*—John J. McGlew

[57] ABSTRACT

In a grinding disc reinforcement fibres of high strength are used and such fibres or normal glass fibres are covered with a protective coating including fine grain.

10 Claims, No Drawings

GRINDING WHEEL CONTAINING GRAIN-COATED REINFORCEMENT FIBERS AND METHOD OF MAKING IT

This is a continuation of application Ser. No. 932,623 filed Aug. 10, 1978, now abandoned.

BACKGROUND OF THE INVENTION

1. Field of the Invention

The invention relates to a grinding wheel comprising grains, a synthetic resin-based, preferably duroplastic binding agent and preferably filler material with a high-strength fibre reinforcement which is embedded in the grinding body.

2. Description of the Prior Art

In grinding, in particular in severing grinding, endeavours are made to attain the highest possible peripheral speeds of the grinding body.

In this respect, the term severing grinding is used to mean grinding through materials, preferably in bar form, with grinding wheels of relatively small thickness; that is to say, the thickness T is generally less than 0,01 of the diameter D:T≦0.01.D.

In technical use, maximum peripheral speeds of 100 m/sec are encountered at present, but peripheral speeds of 130 m/sec and more have already been achieved in testing and laboratory work.

In this respect it will be appreciated that the stricter safety requirements which apply to high-speed grinding operations must be especially considered. Thus, für a grinding wheel operating speed of 100 m/s, a break up (burst speed) of at least 150 m/s is required.

In accordance with the laws of mechanics, increasing the wheel speed to 1.5 times results in an increase of 2.5 times of the maximum stresses which occur in the wheel. This follows from the fact that the tangential stress at the bore of a rotating wheel does not rise linearly with the peripheral speed v, but quadratically, that is to say:

$$\sigma_{tang,\ max} = \text{prop} \cdot v^2$$

However, the advantages of high-speed grinding are so great that this method is being used to an ever increasing extent in practice.

The most important advantages are that the cutting forces at the grain material decrease with increasing speed and the efficiency factor and the specific workpiece removal efficiency (volume of material removed) and the level of edge or profile stability increase in an overproportional manner.

The efficiency factor here is the ratio between the cross-sectional surface area severed, and the disc surface area consumed. The specific removal efficiency denotes the volume of workpiece which is removed in a unit of time per millimeter of wheel width.

Also, endeavours are made to produce severing grinding wheels which are of the smallest possible wheel thickness T. This provides the advantage that on the one hand a lower drive power is required on the part of the severing machine, and that on the other hand the degree of material waste (cutting loss=volume cut away per cut) falls.

This is important particularly in respect of expensive materials such as high-alloy steels, titanium, tungsten and the like. In addition, the degree of heating of the workpieces is lower, and this is advantageous on the one hand in regard to materials which are sensitive to heat or cracking and on the other hand in regard to protection of the environment (reducing the required content of grinding-active filler materials in the wheels).

A further requirement made on severing grinding wheels is that the wheel diameter D and thus the useful wheel surface area should be as large as possible. Such a wheel affords the possibility of cutting through larger cross-sections or longer service periods (reduction in wheel replacement costs). At the present time, severing grinding wheels of up to 1200 mm diameter can be produced by a mass production operation, and severing grinding wheels up to 1800 mm can be produced individually.

It is known however that the lateral rigidity of a wheel falls in proportion as the thickness of the wheel is decreased and the diameter of the wheel is increased, that is to say, the greater the ratio D to T of a severing grinding wheel, the greater is the tendency of the wheel to flutter and the greater is the tendency for the cut to wander off course. This can result in rough cut surfaces, cuts which are not correctly angled, and damage to the grinding wheel.

For this reason therefore, a high degree of static rigidity and a high level of dynamic stability are required, particularly for high operating speeds.

It follows from the laws of mechanics that a high degree of rigidity is linked to a high resonance frequency $f_{res}$. For planar circular plates, the following formula applies:

$$f_{res} \sim \frac{T}{D} \sqrt{\frac{E}{\rho\,(1 - \nu^2)}}$$

in which E denotes the modulus of elasticity, $\rho$ denotes the density an $\nu$ denotes the Poisson number of the wheel.

In practicem T,D,$\rho$ and $\nu$ are virtually fixed predetermined parameters, so that an increase in stability is possible only by means of an increase in the modulus of elasticity (abbreviated to E-modulus).

However, like mechanical strength, the E-modulus is virtually predetermined with the conventional grain-resin combinations, as the selection (kind of grain, grain size, proportion of resin, etc) must be effected primarily from the points of view of the grinding operation. Now, in order to withstand the centrifugal and tangential forces which occur at the high peripheral speeds mentioned above and to increase the moduls of elasticity and thus the rigidity and stability of the wheels, with the grinding bodies which are in technical operation at the present time, it is usual to provide a fibre reinforcement. In particular, glass fibres are used in the present state of the art, as conventional organic fibres generally have insufficient heat resistance.

This latter consideration applies both to the grinding operation and also to the vuring operation, which, in the case of organic grinding body binding agents (phenol or epoxy resins and the like) is generally effected at temperatures of from 150° to 190° C.

In this respect, glass fibres are used:

(a) in the form of short fibres statistically distributed in the binding agent, (b) in the form of tangled fibre fleeces, (c) in the form of woven cloth.

In these cases, the fleeces and the woven cloth are provided with resin impregnation which generally comprises phenol resins so as to provide satisfactory transmission of force from the grinding material to the reinforcement, or so that all individual fibres are uniformly leaded ('take their share of the load'). In the course of technical development, many attempts were made to increase the effectiveness of the glass fibres in the cloth hank), special types of cloth, such as three-directional cloth, round cloth discs with preferably radial thread direction and improvements in adhesion by special surface treatment of the glass fibres (for example by silane).

In practice however it has been found that the above-mentioned advances, which can be achieved by the fibre reinforcement, are nullified to a considerable extent by damage to the fibres in the production of the grinding bodies. The sharp edges of the grinding grains cut through the fibres or produce nicks in the surface of the fibres, simply in the pressing operation. The more the grinding grains are splintery and sharp-edged (for example silicon carbide, high-quality corundum), and the higher the density of the wheel structure, the more serious do such phenomena become, as a high compressing pressure is required to produce such wheels. For example, glass cloths which are removed again from uncured grinding wheels present reductions in strength of between 5 and 90%.

This damage to the fibres in the production of the grinding wheels also represents one of the main difficulties when using high strength carbon fibres as the reinforcement.

Apart from this, it should also be mentioned that, considered from the purely technical point of view, glass fibre threads, in particular the high-strength types, age relatively easily and quickly. Thus, particularly under conditions of severe dampness, the fibres may suffer from a reduction in strength of up to 30% in one hundred days. Glass fibres suffer from a further irreversible fall in strength simply in the vuring operation, the fall in strength at a curing temperature of 200° C. being in fact from 10 to 20%.

In order to avoid the fall in strength in the reinforcing fibres due to damage and ageing, it has been necessary to incorporate a safety reserve in the form of higher proportions of reinforcement.

However, such an increase in the volume of reinforcement in the grinding wheel gives rise to serious disadvantages. In particular, it necessarily results in a fall in the content of wheel material which is active in the grinding operation (grain and active filler materials) and thus a drop in the efficiency factor. When using a glass fibre reinforcement, it is also found when grinding that there is a tendency for the wheel surface to be smeared by molten glass, so that the cutting capacity falls severely and the wheel grinds hotter. Moreover, similar phenomena also occur generally when using thermoplastic fibre materials.

SUMMARY OF THE INVENTION

It is now the problem of the invention to provide a grinding wheel, in particular a severing grinding wheel, which, while having the same or a smaller content of reinforcement, permits higher peripheral speeds with a sufficient degree of stability and cool grinding.

According to the invention, this is achieved in that the reinforcement has fibres of more than 10 mm in length, whose E-modulus is higher than $1\times10^4$ kp/mm$^2$.

The invention preferably provides that the reinforcement is provided with a coating which has good adhesion to the fibre and which with the wheel binding agent forms a mechanically sufficient chemical and/or physical connection and which is formed by a resin or a mixture of resin and the binding agent used in the grinding body, wherein the reinforcement is laid into a layer of fine grain material of fine-grain filler material which is active in the grinding operation.

According to the invention, the reinforcement fibre material are high-strength glass fibres, single-crystal whiskers, polycrystalline metal whiskers, carbon fibres, boron fibres and drawn metal wires. In addition, born nitride, silicon carbide and high-strength heat-resistant organic fibres with a high E-modulus (for example polyaramide).

Metal wires which may be considered in accordance with the invention include in particular wires comprising a high-alloy C-steel.

The following values may be given as basic values, in regard to order of magnitude, of the modulus of elasticity and the tensile strength of these fibres:

| | |
|---|---|
| Modulus of elasticity | E = 100 GN/m$^2$ (kN/mm$^2$) |
| Tensile breaking strength | Z,B = 2 GN/m$^2$ (kN/mm$^2$) . |

In order to improve the adhesion of the fibres in the matrix of the binding agent, the invention provides that the fibres are provided with a surface layer which has a high chemical and/or physical affinity with respect to the binding agent and the fibres.

For this purpose for example the metal wires may be provided with a primer. Carbon fibres are preferably subjected to surface oxidation or C-whiskers or SiC-whiskers are refined at their surface.

High-strength fibers often give rise to difficulties in the production of cloths of standard structure (approximately equal strength and rigidity in the weft and warp directions). Therefore, the invention further provides that the wheel has as reinforcement at least one cloth whose weft (or warp) comprises fibres with the above-mentioned highstrength and E-modulus properties and whose warp (or weft respectively) is formed by more elastic and more flexible fibres, for example conventional glass or organic fibres (so-called indirectional cloth).

A preferred embodiment provides at least two cloths of this kind, in a crossed arrangement.

The fine grain used includes the known grinding agents such as für example corundums, silicon carbide, boron carbide which are about as hard as the grinding agents or grains of the wheels, while the grinding-active or reactive filler materials include for example cryolite, pyrite, etc.

In this respect, the reinforcement may be laid into the fine grain material, either when impregnating the reinforcement material, as a preparatory operation, or only when finishing the grinding body.

By virtue of this fine-grain enclosure, which is obviously saturated by the above-mentioned coating material in the manufacturing process, which is not the subject of this invention, on the one hand the reinforcement fibres are protected in the process of producing the grinding bodies (pressing), and on the other hand the above-mentioned coating in the manufacturing process, which is not the subject of this invention, on the one hand the reinforcement fibres are protected in the process of producing the grinding bodies (pressing), and on the other hand the above-mentioned effect of smearing of the surface of the grinding wheel when grinding is reduced. The high mechanical strength and E-modulus values are maintained, even when using reinforcing materials which are very sensitive to nicking, for example carbon fibres.

The construction according to the invention of the grinding wheel or severing grinding wheel provides for a high permissible peripheral speed with a low tendency to flutter, high dynamic stability and thus the lowest possible tendency to wandering of the cut. In addition, the danger of the wheel breaking up is substantially reduced.

The construction of the invention also provides an improvement in the surface quality of the materials which are ground or cut through with such grinding wheels.

It has been found essential that the reinforcing fibres or wires which are used according to the invention, while having the same or even higher tensile strength, having a substantially higher E-modulus, than conventional reinforcing fibres, which higher E-modulus is fully maintained of suffers only a slight fall, until the wheels are used.

According to the invention, it was possible to produce grinding wheels whose E-modulus was five times that of conventional wheels provided with a conventional glass fibre reinforcement. Likewise, the mechanical strength values (tensile strength, rupture limit peripheral speed of the wheels) were double the usual values.

This is of particular importance because an increase in the E-modulus is possible only to a limited extent, with the organic grinding body binders as such (phenol, epoxy and polyester resins and the like), which are at present in technical use. Therefore, in practice only the course which involves fibre-reinforced composite materials is suitable.

Hereinafter a table of the E-modulus and strength values achieved in fibre-reinforced test bodies.

The sample grinding bodies were produced in the usual manner from abrasive grain and a mixture of phenol resins with inorganic filler materials, as the binding agent. The ratio (by weight) of resin to filler material was 1:1.

With all types of fibres, the proportion forming the reinforcement was 20% by volume of the grinding mass (grain+binding agent). The fibres were used in the form of unidirectional cloths in order to reduce the influences of the weaving operation or in order to be able to produce the cloths as easily as possible.

The surfaces of the fibres were provided with surface coatings to improve adhesion; thus, the C-fibres were oxidised an the steel wires and glass fibres were provided with a primer.

Data on the reinforcing fibres used:

| Name | More precise identification | E-modulus $GB/m^2$ | Breaking strength $GN/m^2$ |
|---|---|---|---|
| Glass | E-glass, low alkali content | 73 | 2.2 |
| | S-glass | 85 | 4.4 |
| Steel | Carbon Steel | 200 | 4.0 |
| C-fibre | Carbon fibre of medium strength and E-modulus | 300 | 2.5 |
| B-fibre | Boron filament with tungsten core | 420 | 3.0 |

The impregnation of the cloths and density of the fibres was of the same composition as the binding of the wheels of phenol resin and fine-grain inorganic filler material. The grains of the fine-grain filler had a diameter much smaller than that of the fibers of the cloth. The cloth was saturated with phenol resin solution, laid into the filler material, and then pre-dried in conventional manner to such an extent that it had the necessary working consistency.

Basic recipe:

| | |
|---|---|
| Normal corundum 30 mesh | 70 parts |
| Phenolresol (fluid) | 10 parts |
| Phenol resin/Novolak (powder) | 4 parts |
| cryolite (powder) | 14 parts |

Pressing density (without reinforcement)=2.70.

Two crossed cloths were then incorporated into the grinding body, as internal reinforcement, in such a way that the two outer layers of grinding material are each half the thickness of the middle layer. The wheels were pressed and cured in the usual manner.

The E-modulus and strengths were then measured and the resonance frequency was calculated from the E-modulus. As already stated above, the resonance frequency is a measurement of the lateral rigidity and dynamic stability of the wheel, and thus a criterion for the possible peripheral (working) speed when grinding.

The results are diagrammatically summarised in the following table. The measurement values of the grinding bodies according to the invention, with glass fibres as the reinforcement, were in each case taken as the base (100%).

| Material of the reinforcement | E-modulus of the test bodies in % | Resonance frequency of the test bodies in %(X) | Possible peripheral speed when grinding in % |
|---|---|---|---|
| Glass | 100 | 100 | 100 |
| Fine steel wire | 250 | 150 | 150 |
| C-fibre | 400 | 200 | 200 |
| B-fibre | 500 | 220 | 220 |

(X)Values for resonance frequency calculated from the measured values of the E-modulus It was found that there is a close agreement between the possible peripheral speeds which were determined by way of the calculated resonance frequencies, and the dynamic which was found in a grinding test. A further criterion is obviously the permissible speed which is fixed on the basis of the burst peripheral speed and the safety regulations. For example, when using S-glass, this permissible speed would be about 30% higher than when using E-glass, but the dynamic stability with both types of glass is approximately the same. Therefore, it is possible to make use of high strength values only in regard to fibres which also have a high E-modulus. A further prerequisite is that the E-modulus is maintained during the process of producing the grinding bodies.

When performing a grinding operation with the test grinding bodies, substantially less coating of the wheel surface was found, than in the case of conventional wheels.

Therefore, the present invention makes it possible on the one hand to achieve increases in operating speed, with high-strength fibres such as carbon fibres, steel fibres, boron fibres, etc, without an increase in the relative volume of reinforcement in the grinding wheel, and on the other hand, the loss of strength which occurs with conventional production methods and which, as already mentioned above, is from 5 to 90%, can be greatly reduced by the embedding effect according to the invention.

This latter therefore also provides considerable advantages when using the usual glass fibres.

What we claim is:

1. A method of making a high-speed grinding disc having grinding grains and fibers of reinforcing material comprising:

coating the fibers which have a length of more than 10 mm with a resin based binder and fine grain particles having diameters much smaller than that of the fibers and made of material which has substantially the same hardness as the material making up the grinding grain to form fibers with a binder and fine grain coating;

mixing the coated fibers with additional binder and the grinding grain to form a mixture; and pressing the mixture to form the grinding discs wherein the coated fibers are protected from being damaged by compression against the grinding grain.

2. A method according to claim 1 including first coating the fibers with the first-mentioned binder which has a good adhesion to the fibers and subsequently laying the fibers into the fine grain to attach the fine grain to and cover the fibers.

3. A method according to claim 2, wherein said fine grain includes reactive filler materials.

4. A high speed grinding disc comprising: a synthetic resin matrix carrying abrasive grains and coated reinforced fibers, said coated reinforcement fibers having an outer coating of synthetic resin having embedded therein fine grain of a material having substantially the same hardness as said abrasive grain with a diameter substantially smaller than that of said fiber, said fine grain covering said fiber and protecting said fiber from damage from abrasive grain pressed against said fiber during the formation of said high-speed grinding disc.

5. A high-speed grinding disc according to claim 4, wherein said fine grain includes reactive filler material.

6. A method according to claim 1 wherein said coated fibers are mixed with the additional binders and grinding grain in a layer of coated fibers.

7. A grinding disc according to claim 4, wherein said fiber reinforcement is chosen from the group consisting of a single crystal whisker, polycrystalline metal whiskers, boron fibers, synthetic whiskers, glass fibers, and drawn metal wires.

8. A grinding disc according to claim 7, wherein said fiber reinforcement comprises drawn metal wires comprising high alloy carbon steel.

9. A grinding disc according to claim 4, wherein said fiber reinforcement is woven into a cloth with a weft having fibers of an E-modulus of more than $1\times10^4$ kg/mm$^2$ and whose warp is formed by more elastic and flexible fibers.

10. A grinding disc according to claim 9 comprising two of said cloths connected by said binding agent with the weft of one cloth extending parallel to the warp of the other cloth.

* * * * *